United States Patent [19]

Dick

[11] 4,249,110

[45] Feb. 3, 1981

[54] CONTROLLED ENERGY CUT-OFF FOR AN ELECTRONIC FLASH DEVICE

[75] Inventor: John D. Dick, Thiensville, Wis.

[73] Assignee: Rollei of America, Inc., Littleton, Colo.

[21] Appl. No.: 1,016

[22] Filed: Jan. 4, 1979

[51] Int. Cl.[3] ..... H05B 41/29

[52] U.S. Cl. ..... 315/241 P

[58] Field of Search ..... 354/32–34, 354/60 F, 127, 128, 145; 315/241 P, 241 R

[56] References Cited

U.S. PATENT DOCUMENTS

| | | | |
|---|---|---|---|
| 3,644,818 | 2/1972 | Paget | 315/241 PX |
| 3,863,128 | 1/1975 | Wilwerding | 315/241 PX |
| 3,914,647 | 10/1975 | Broekstra et al. | 315/241 P |
| 3,971,049 | 7/1976 | Ohmori et al. | 354/33 X |
| 4,012,665 | 3/1977 | Nakamura et al. | 315/24 P |

*Primary Examiner*—L. T. Hix
*Assistant Examiner*—William B. Perkey
*Attorney, Agent, or Firm*—Allegretti, Newitt, Witcoff & McAndrews

[57] ABSTRACT

A first circuit arrangement including a zener diode coupled to the base of a transistor for keeping the transistor turned ON in response to the magnitude of voltage developed across a storage capacitor. The capacitor provides power to a photographic flash tube connected in series with a silicon controlled rectifier (SCR). After the flash tube is ignited, energy is drained from the charged capacitor until its voltage level reaches a predetermined magnitude at which time the zener diode becomes non-conducting, turning OFF the transistor, which causes a commutation of the SCR, terminating the flash of the flash tube. The capacitor is then recharged for preparation of the next flash operation.

A second circuit arrangement utilizes a programmable unijunction transistor in which the voltage magnitude of the flash storage capacitor is followed by the gate of the unijunction transistor until the gate voltage reaches a corresponding voltage level preset at the anode of the unijunction transistor. The preset voltage level is a stored voltage which is proportional to the capacitor voltage immediately prior to flash actuation.

7 Claims, 2 Drawing Figures

CONTROLLED ENERGY CUT-OFF FOR AN ELECTRONIC FLASH DEVICE

BACKGROUND OF THE INVENTION

The invention relates to a method and apparatus for controlling the flashing operation of an electronic flash system and more particularly relates to a method and apparatus for improving the efficiency of the voltage converter which powers the electronic flash.

Electronic flash devices are known in the art in which a single flash tube of the device is utilized to take a plurality of flash pictures. Prior to the taking of each picture, a battery-powered circuit charges a storage capacitor to a relatively high voltage level for driving the flash tube upon the photographer closing the camera switch.

During the flash, the voltage on the storage capacitor is drained until there is insufficient voltage across the capacitor to maintain the flash tube in conduction or until the flash is purposely terminated by an automatic control circuit. After the flash has been terminated, the storage capacitor is recharged in preparation for taking the next picture.

A voltage converter circuit which charges the capacitor is powered by a battery which permits a certain number of flashes to be performed in accordance with the life of the battery. Thus, a method and apparatus for increasing the number of flashes permitted with a single battery charge would be highly welcomed.

Further, it would be desirable to increase the voltage converter efficiency in not only automatic flash termination systems in which the flash duration is automatically controlled, but also in non-automatic flash systems in which the flash is terminated due to voltage drain on the flash capacitor. Also, it would be desirable to maintain an adequate light output from the flash as the capacitor's charged voltage level decreases during battery life.

SUMMARY OF THE INVENTION

It is therefore, an object of the present invention to increase significantly the number of flashes obtainable from a single battery charge in an electronic flash device.

It is another object of the present invention to increase voltage converter efficiency in both automatic and non-automatic duration-controlled flash systems.

It is another object of the present invention to maintain an adequate light output from the flash as the flash storage capacitor's charged voltage level decreases during battery life.

These and other objects are accomplished by monitoring an electrical signal level representative of the energy being put out by the flash tube during flash operation and terminating the flash when the monitored signal level reaches a prescribed cut-off level. In a preferred embodiment, the cut-off level is programmed in relation to battery life by monitoring the voltage level across the flash storage capacitor immediately prior to flash actuation. By terminating the flash at a pre-programmed signal level, the flash storage capacitor is prevented from completely discharging and energy is returned to the capacitor from a battery-powered voltage converter circuit in a more efficient manner.

DESCRIPTION OF THE PREFERRED EMBODIMENTS

Figure 1:
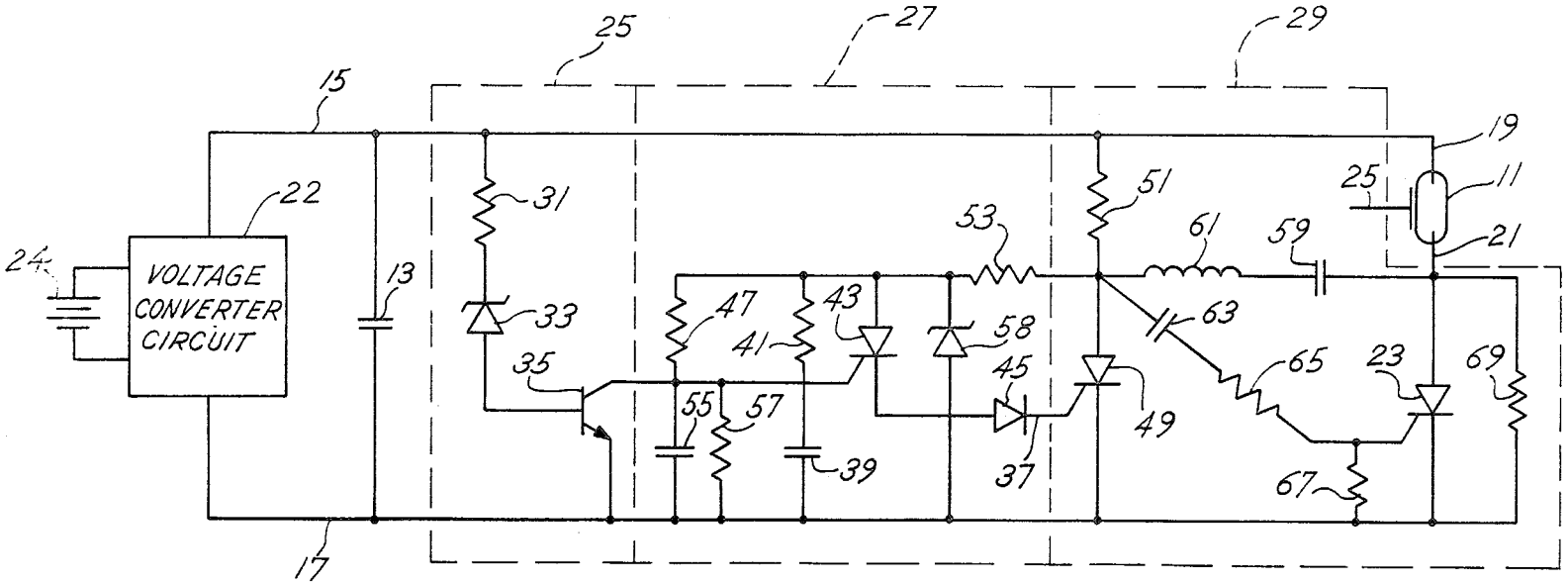
FIG. 1 is an electrical circuit diagram of a preferred embodiment of the present invention.

Referring to FIG. 1 of the drawings, the illustrated and described flash apparatus is one which includes a conventional type of electronic flash tube 11 together with a main flash storage capacitor 13 for supplying power along a pair of conductors 15, 17 to drive flash tube 11 upon actuation thereof. Flash tube 11 has an anode electrode 19 connected to conductor 15 and a cathode electrode 21 connected to conductor 17 via the anode-cathode junction of a silicon controlled rectifier (SCR) 23.

Capacitor 13 is normally maintained in a charged state by a conventional voltage converter circuit 22 which is powered by a battery 24, whereby a relatively high voltage is maintained between conductors 15, 17. When flash tube 11 is to be fired, a camera switch (not shown) is closed resulting in a trigger pulse being applied to the flash tube by a conventional trigger circuit (not shown) via a trigger electrode 25 of the flash tube. The firing of tube 11 triggers SCR 23 into conduction, as described hereinafter, placing the voltage of conductors 15, 17 directly across flash tube 11.

Without an automatic control portion of the apparatus, tube 11 will continue to emit light until due to the conduction of tube 11, the charge on capacitor 13 and the voltage between conductors 15, 17 drop sufficiently to cause the tube 11 to be extinguished. Thereafter, the capacitor 13 is recharged to be ready for the next firing of the tube.

However, where an automatic control portion is included with the apparatus, a quenching circuit (not shown) is connected for causing an immediate extinguishment of the flash tube upon a predetermined quantity of light being received back from the photographed scene. This may be accomplished by turning off SCR 23 by the well known commutation technique.

The commutation of SCR 23 is utilized in the preferred embodiment for extinguishing the flash tube when the voltage level of capacitor 13 drops to a predetermined voltage level, as energy is dissipated by flash tube 11. A voltage monitoring circuit 25 monitors the voltage level developed across capacitor 13 for signaling a commutation trigger circuit 27 that the monitored voltage has dropped to a predetermined value. Trigger circuit 27 generates a current trigger signal to commutation circuit 29 for extinguishing the flash tube 11 by commutation of SCR 23.

Voltage monitoring circuit 25 includes a resistor 31, a zener diode 33 and a transistor 35. Resistor 31 connects conductor 15 to the cathode of zener diode 33, the anode of which is connected to the base of transistor 35. The collector-emitter path of transistor 35 is connected between trigger circuit 27 and conductor 17. Transistor 35 acts as a switch for clamping its collector to conductor 17 whenever the transistor is ON, and for effectively disengaging the collector from conductor 17 whenever the transistor is OFF.

Zener diode 33 switches transistor 35 to its ON or its OFF state by regulating current flow into the base of transistor 35. Current is passed by zener diode 33 for turning ON transistor 35 whenever the voltage level impressed across the zener diode is at or above a predetermined value.

Prior to flash actuation, the voltage developed across flash capacitor 13 is of a sufficient value to keep zener diode 33 in a state of conduction maintaining transistor 35 in an ON state. After flash initiation, the voltage on capacitor 13 decreases until it reaches the voltage level at which zener diode 33 stops conducting and transistor 35 is turned OFF, disconnecting the transistor's collector from conductor 17.

The voltage level of capacitor 13 at which zener diode 33 stops conducting is determined according to the characteristics of zener diode 33. As will be understood, a separate resistor may be connected between the base and emitter of transistor 35.

The switching of transistor 35 commands trigger circuit 27 to produce a current trigger signal along an output trigger lead 37 connected to commutation circuit 29. The current trigger signal is produced by a capacitor 39 discharging through a series connected circuit of a resistor 41, the anode-cathode path of an SCR 43 and the anode-cathode path of a diode 45, into trigger lead 37. SCR 43 serves as the control element for producing the trigger current signal in response to a control signal developed at its gate. The gate of SCR 43 is connected to the collector of transistor 35 such that when the transistor 35 is in its ON state, the gate of SCR 43 is clamped to conductor 17 keeping the SCR turned OFF.

When transistor 35 switches to its OFF state, current flows out of capacitor 39 through resistor 41 and into the gate of SCR 43 via a resistor 47 which connects resistor 41 to the gate of SCR 43. The current flowing into the gate of SCR 43 passes through the gate-cathode junction of SCR 43, through the anode-cathode junction of diode 45 and returns to capacitor 39 via the gate-cathode junction of an SCR 49 of commutation circuit 29. This action triggers SCR 43.

Capacitor 39 is charged through a voltage divider circuit connected between conductors 15, 17, including resistor 41 and a pair of resistors 51, 53 series connected between conductor 15 and resistor 41. A capacitor 55 and a resistor 57 are connected in parallel between the gate of SCR 43 and conductor 17, for preventing false triggering of SCR 43 by noise signals. Also, a zener diode 58 connects the anode of SCR 43 to conductor 17 for regulating the voltage developed at the anode of SCR 43.

Commutation circuitry 29 responds to the current trigger signal developed along lead 37 to commutate SCR 23. SCR 49 acts as a control device of the commutation circuitry for initiation of the commutation function. The gate of SCR 49 is connected to trigger lead 37 for receiving the current trigger signal.

Prior to flash actuation, SCR 23 is in an OFF condition. When flash tube 11 fires, its resistance value drops to a very low value which causes a sharp rise in the voltage at the anode of SCR 23. This rise in voltage is coupled through a series-connected circuit of a capacitor 59, an inductor 61, a capacitor 63, and a resistor 65 into the gate of SCR 23 turning the SCR ON. A resistor 67 is connected between the gate of SCR 23 and conductor 17.

Capacitors 59, 63 are charged prior to flash actuation via a voltage divider network which includes a resistor 69 connected between the anode and cathode of SCR 23, and a resistor 51 which is connected between conductor 15 and inductor 61.

SCR 49 is connected between resistor 51 and conductor 17 with its anode at resistor 49. When a current trigger signal is applied to the gate of SCR 49, the SCR is turned on, clamping the junction between inductor 61 and capacitor 63 to conductor 17. This action establishes a negative voltage across the anode-cathode of SCR 23, turning SCR 23 OFF, thereby interrupting current flow in flash tube 11, and turning the light flash off. Inductor 61 which is connected between the anode of SCR 49 and capacitor 59 protects SCR 49 by limiting peak forward currents during commutation. As will suggest itself, a resistor may be connected between the gate of SCR 49 and conductor 17.

During the flash operation, the voltage waveform-appearing across capacitor 13 is indicative of the energy being dissipated from capacitor 13 and indicative of the energy that is being put out by flash tube 11. Monitoring circuit 25 effectively monitors the energy that is being put out by tube 11, by monitoring the voltage waveform across capacitor 13. When the energy put out by tube 11 reaches a certain energy value, as represented by a predetermined voltage value across capacitor 13, the flash is terminated and the storage capacitor is recharged for preparation of the next flash.

If capacitor 13 has some initial charge voltage stored prior to recharging, the energy conversion efficiency for charging the capacitor from that initial voltage to its final charged voltage is increased as compared to the case where no initial voltage was stored prior to recharging. Thus, by using a capacitor of capacitance larger than that necessary to provide a certain amount of energy output, the capacitor need not be fully discharged to provide such an energy output and, therefore, the efficiency of restoring that energy is increased. Thus, by using a capacitor larger than that which is needed, and terminating the flash after the desired quantity of light energy has been produced, the voltage converting circuitry recharges the capacitor in a more efficient manner, resulting in a greater number of flashes performed by the battery source of the voltage converting circuitry.

Figure 2:
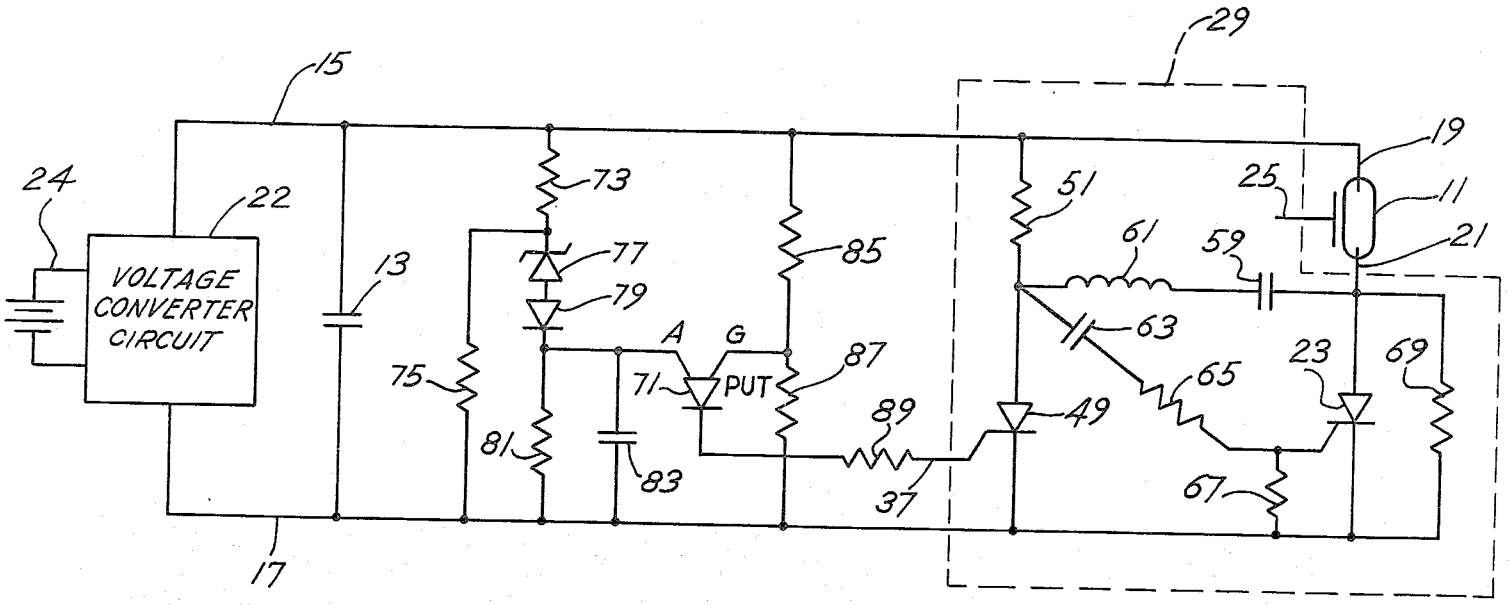
FIG. 2 is an electrical circuit diagram of another preferred embodiment of the present invention.

Referring to FIG. 2, a second embodiment of the invention is illustrated in which the monitored voltage value of capacitor 13 is established as a function of the flash tube anode voltage prior to flash actuation. Thus, adequate energy for the required light output is maintained as the anode voltage of flash tube 11 decreases during battery life.

The determination of the capacitor 13 voltage level which will cause a commutation to terminate the flash of flash tube 11, is controlled by a programmable unijunction transistor (PUT) 71. The anode of PUT 71 is biased and maintained during the flash at a voltage determined by the voltage on capacitor 13 just prior to the flash, and the gate of PUT 71 is biased at a voltage level which proportionately follows the voltage on capacitor 13 as its voltage decreases during the flash. When the voltage at the gate of PUT 71 reaches the preset biased voltage at the anode, PUT 71 turns on and initiates the commutation of the flash sequence along lead 37.

The anode of PUT 71 is biased at a voltage determined by a voltage divider circuitry connected across storage capacitor 13, including a pair of series-connected resistors 73, 75 connecting conductors 15, 17; a zener diode 77, a diode 79 and a resistor 81 are series-connected in parallel with resistor 75. A capacitor 83 is connected across resistor 81 for storing a voltage level at the anode of PUT 71, which anode is connected to the junction of resistor 81 and diode 79.

As the voltage on capacitor 13 decreases during the flash, voltage stored on capacitor 83 is substantially maintained, presetting the voltage on the anode of PUT 71. Diode 79 prevents capacitor 83 from discharging back through the zener diode.

The voltage on the gate of PUT 71 is provided by a voltage divider circuit comprising a pair of series-connected resistors 85, 87 connected between conductors 15, 17. The gate of PUT 71 is connected between the circuit node connecting resistors 85 and 87. The voltage developed at the gate of PUT 71 is a ratio of the voltage stored on capacitor 13 and follows the capacitor voltage as it falls away during the flash.

When the voltage at the gate reaches the preset bias voltage at the anode of PUT 71, the transistor turns on to initiate commutation of the flash sequence. The cathode of PUT 71 is connected via a resistor 89 to the gate of commutation SCR 49 for turning the same on when PUT 71 begins to conduct.

It should be understood, of course, that the foregoing disclosure relates to preferred embodiments of the invention and that other modifications or alterations may be made therein without departing from the spirit or scope of the invention as set forth in the appended claims.

What is claimed is:

1. A flash device comprising:

flash means electrically actuable for producing a photographic flash;

storage capacitor means for powering said flash means;

voltage converter circuitry for charging said capacitor means to a relatively high voltage level;

voltage monitoring means for monitoring the voltage developed across said capacitor means during actuation of said flash, said voltage monitoring means including means for electrically establishing a voltage value representative of the discharge cut-off voltage level for said capacitor means, said means establishing said voltage value at a value which varies in relation to the voltage developed across said capacitor means immediately prior to flash actuation, said voltage monitoring means for generating an electrical signal when the monitor voltage substantially equals said established cut-off voltage level; and means connected to said voltage monitoring means for extinguishing said flash means responsive to said electrical signal.

2. A flash device according to claim 1 wherein said means for establishing a voltage value includes:

means for monitoring the voltage developed across said capacitor means immediately prior to flash actuation; and storage means for storing a voltage representative of said last-named monitored voltage.

3. A flash device according to claim 2 wherein said voltage monitoring means includes means for generating a voltage representative of said voltage developed across said capacitor means; and means for comparing said stored voltage with said voltage representative of said voltage developed across said capacitor means.

4. A flash device according to claim 3, wherein said means for comparing comprises a unijunction transistor.

5. In an electronic flash device having a flash tube, a storage capacitor for powering the flash tube, and a voltage converter device and a battery for charging the storage capacitor, a method for increasing the life of the battery, comprising the steps of:

establishing a voltage cut-off value for the storage capacitor, including:

(i) monitoring the voltage across the storage capacitor immediately prior to each flash actuation; and (ii) determining the voltage cut-off value based on the monitored voltage;

monitoring the voltage level across the storage capacitor with respect to the voltage cut-off value, during flash actuation;

terminating the flash of the flash tube when the last-named monitored voltage substantially equals the determined voltage cut-off values; and recharging the storage capacitor in preparation for the next flash.

6. A method according to claim 5 where in said step of establishing a voltage cut-off value includes the step of storing a voltage value representative of the voltage across the storage capacitor immediately prior to each flash actuation.

7. In an electronic flash device having a flash tube, a storage capacitor for powering the flash tube, and a voltage converter device and a battery for charging the storage capacitor, a method for efficiently replacing energy in the storage capacitor, comprising the steps of:

generating a signal representative of the energy being put out by the flash tube during flash operation;

monitoring the signal;

establishing a signal cut-off level representative of an energy cut-off value including the steps of:

(i) monitoring the voltage across the storage capacitor immediately prior to flash actuation; and (ii) establishing the signal cut-off level in relation to the monitored voltage;

extinguishing the flash when the signal reaches its signal cut-off level; and recharging the storage capacitor in preparation for the next flash.

* * * * *